US005410927A

United States Patent [19]

Omata et al.

[11] Patent Number: 5,410,927

[45] Date of Patent: May 2, 1995

[54] LOW NOISE PUNCH TOOL

[75] Inventors: Hitoshi Omata; Oriya Fujita, both of Kanagawa, Japan

[73] Assignees: Amada Compmany, Limited; Amada Meirecs Company, Limited, both of Kanagawa, Japan

[21] Appl. No.: 92,468

[22] Filed: Jul. 16, 1993

[51] Int. Cl.[6] ..... B26F 1/14

[52] U.S. Cl. ..... 83/139; 83/684; 181/209

[58] Field of Search ..... 83/139, 140, 143, 142, 83/141, 138, 684, 686; 181/209, 207

[56] References Cited

U.S. PATENT DOCUMENTS

| | | | |
|---|---|---|---|
| 2,867,276 | 1/1959 | Taylor | 83/140 X |
| 2,983,176 | 5/1961 | Taylor | 83/138 |
| 3,211,035 | 10/1965 | Whistler, Sr. et al. | 83/139 |
| 3,622,067 | 11/1971 | Bucy et al. | 83/917 |
| 4,092,888 | 6/1978 | Wilson | 83/143 X |
| 5,176,057 | 1/1993 | Chun et al. | 83/140 X |

FOREIGN PATENT DOCUMENTS 3-4318 1/1991 Japan .

*Primary Examiner*—Kenneth E. Peterson

*Attorney, Agent, or Firm*—Sandler, Greenblum & Bernstein

[57] ABSTRACT

The low noise punch tool (17) of this invention includes an upper surface pad (51) formed of a low noise material and disposed on an upper surface of a punch head (37) to be struck by a striker (25) of a punch press. Further, an elastic member (55) formed of a low noise material is interposed between the punch head (37) and a punch guide (43), and a ring (53) formed of a low noise material is interposed between the punch body (39, 41) and the punch guide (43). The low noise punch tool (17) includes a lower surface pad (63) formed of a low noise material and attached to a lower surface of a stripper plate (45) provided at a lower end of the punch guide (43). The low noise material may be urethane. Yet further, the cutting edge (**41*a*) provided at the lower end of the punch body (41**) has preferably a shearing angle. This punch tool is advantageous in that the noises of the punch tool during punching is significantly reduced, and the structure thereof is simple.

5 Claims, 3 Drawing Sheets

LOW NOISE PUNCH TOOL

BACKGROUND OF THE INVENTION

1. Field of the Invention

The present invention relates to a punch tool adapted to be mounted on a turret punch press, and in particular to a low noise punch tool which generates a low noise when punching a workpiece.

2. Description of the Prior Art

Conventionally, a punch tool has been formed with a shearing angle in order to reduce punching noise generated when a workpiece is punched out by a turret punch press, for example. However, it is desired further to reduce the punching noise generated during the punching processing.

SUMMARY OF THE INVENTION

Accordingly, it is the object of the present invention to provide a low noise punch tool which can significantly reduce the punching noise, and is simple in structure.

To achieve the above-mentioned object, the present invention provides a low noise punch tool. The low noise punch tool includes an upper surface pad (51) formed of a low noise material and disposed on an upper surface of a punch head (37) of a punch tool (17). The head (37) is be struck by a striker (25) of a punch press. The low noise punch tool further includes an elastic member (55) formed of a low noise material and interposed between the punch head (37) and a punch guide (43), and a ring (53) formed of a low noise material and interposed between the punch body (39, 41) and the punch guide (43). The low noise punch tool yet further includes a lower surface pad (63) formed of a low noise material and attached to a lower surface of a stripper plate (45) provided at a lower end of the punch guide (43). The low noise material is preferably urethane.

In another aspect of the present invention, the upper surface pad (51) and the lower surface pad (63) includes a plurality of cusp push members (65) arranged circularly at regular angular intervals on the upper surface of the punch head (37) and on the lower surface of the stripper plate (45), respectively.

DETAILED DESCRIPTION OF THE PREFERRED EMBODIMENTS

Embodiments of the low noise punch tool according to the present invention will be described in detail hereinbelow with reference to the attached drawings.

Figure 5:
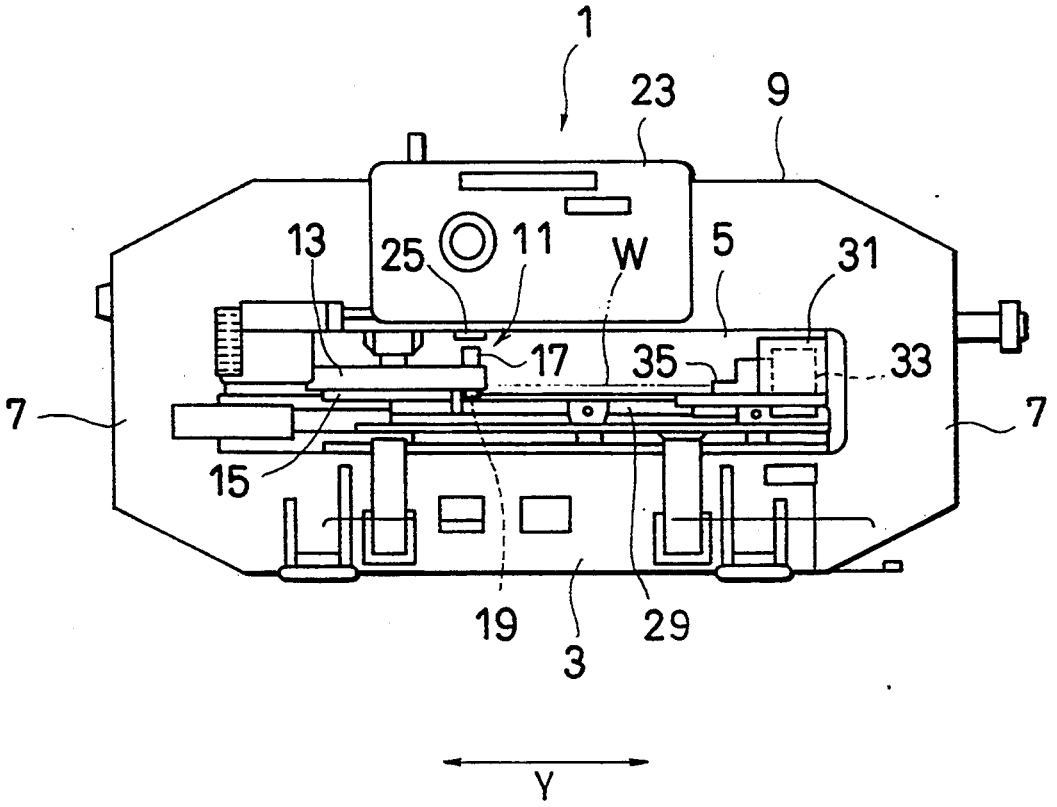
FIG. 5 is a front view showing a turret punch press on which the low noise punch tool according to the present invention is to be mounted.

FIG. 5 is a front view showing a turret punch press on which the low noise punch tool according to the present invention is mounted. In the drawing, the turret punch press 1 is composed of a lower frame 3, a pair of columns 7 disposed on both sides of the lower frame 3 to provide a working area 5, and an upper frame 9 formed integral with the pair of columns 7.

On the left side of the working area 5, a processing section 11 for punching a workpiece W, for instance, is provided. The processing section 11 is composed of an upper disk-shaped turret 13 rotatably mounted on the upper frame 9 and a lower disk-shaped turret 15 rotatably mounted on the lower frame 3 an appropriate distance away from the upper turret 13 in opposite positional relationship with respect to the upper turret 13.

On the upper turret 13, a plurality of upper punch tools 17 are removably arranged circularly at regular angular intervals. In the same way, a plurality of lower die tools 19 are removably arranged circularly on the lower turret 15 so as to face the corresponding upper punch tools 17, respectively.

Both the upper and lower turrets 13 and 15 are rotated by a turret driving mechanism (not shown) in the same direction in synchronism with each other for indexing operation. Further, the indexed upper punch tool 17 is struck against the indexed lower die tool 19 with a striker 25, which is movable up and down by a ram actuating means 23 mounted on the upper frame 9.

On the right side of the working area 5, a fixed table (not shown) for supporting a workpiece W is provided on the lower frame 3. On both sides of the fixed table in the direction that is perpendicular to the sheet of the drawing in FIG. 5, a pair of movable tables 29 also for supporting the workpiece W are provided. The movable tables 29 are movable in the Y-axis (the right and left) direction. A carriage base 31 extending in the directions that is perpendicular to the sheet of the drawing in FIG. 5 is attached to the movable tables 29. A carriage 33 is mounted on the carriage base 31 so as to be movable along the carriage base 31. Further, a work clamp 35 is mounted on the carriage 33 for clamping the workpiece W.

Figure 1:
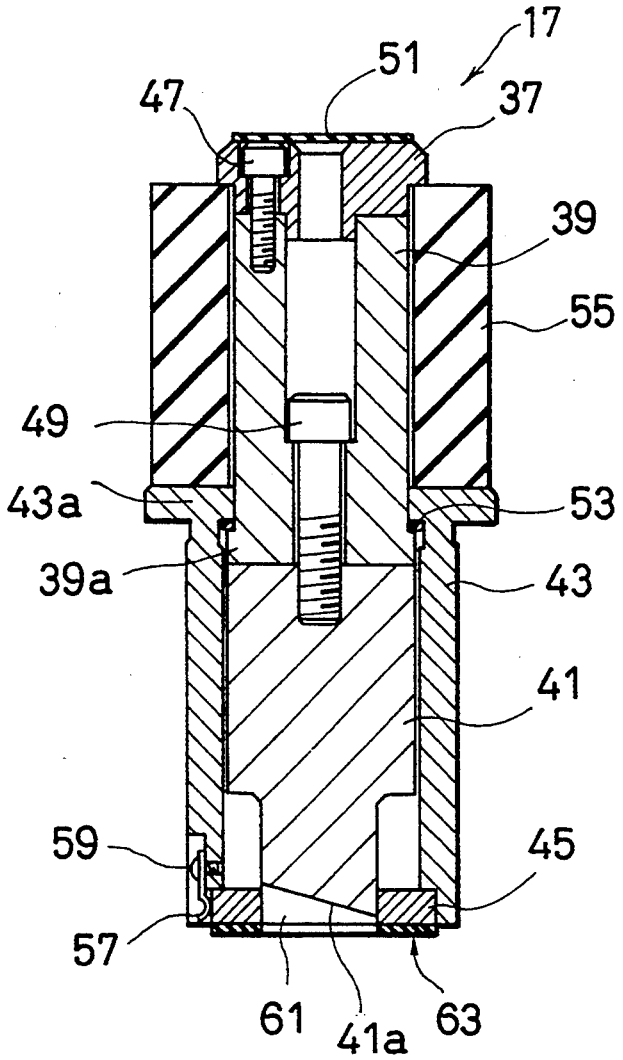
FIG. 1 is a longitudinal cross-sectional view showing an embodiment of a low noise punch tool according to the present invention.

FIG. 1 shows an embodiment of the low noise punch tool 17 according to the present invention. The punch tool 17 is to be attached to the turret punch press as shown in FIG. 5. The low noise punch tool 17 is composed of a punch head 37, a punch driver 39, a punch body 41 formed with an slanted cutting edge 41*a*, a punch guide 43, and a stripper plate 45.

The punch head 37 is fixed to the top end of the punch driver 39 with a plurality of fixing screws 47. Further, an upper surface pad 51 formed of a low noise material (e.g., urethane) is bonded or baked onto the upper surface of the punch head 37. This urethane material serves to reduce noise generated when the punch punch tool 17 is struck by the striker 25 (FIG. 5).

Further, the lower end of the punch driver 39 is fixed to the upper end of the punch body 41 with a fixing screw 49. The cylindrical punch guide 43 is fitted to the outer circumferential surfaces of the punch driver 39 and the punch body 41 to guide the sliding movement of the punch driver 39 and the punch body 41 together in the vertical direction. A ring 53 formed of a low noise material (e.g., urethane) is interposed between a lower stepped portion 39*a* of the punch driver 39 and an upper flange portion 43*a* of the punch guide 43 to reduce noise generated when the punch driver 39 is brought into contact with the punch guide 43 during the upward restoration movement of the punch tool 17 in the upper turret 13.

Further, a stripper spring (elastic member) 55 formed of a low noise material (e.g. urethane) is interposed between the punch head 37 and the the upper flange 43*a* of the punch guide 43 to reduce noise and vibration of the punch tool 17 generated during the movement of the punch driver 39 and the punch body 41 relative to the punch guide 43.

Further, at the lower end of the punch guide 43, the stripper plate 45 is held by a plurality of plate push members 57 and a plurality of push screws 59. A slanted cutting edge (knife-edge) 41*a* is formed with a shearing angle. Here, the cutting edge 41*a* is adapted to pass through an opening 61 of the stripper plate 45 so as to project downward from the stripper plate 45 and perform punch processing. Further, a lower surface pad 63 formed of a low noise material (e.g., urethane) is bonded or baked onto the lower surface of the stripper plate 45. This urethane material serves to reduce noise generated when the stripper plate 45 is brought into contact with the workpiece W to be processed.

Figure 2:
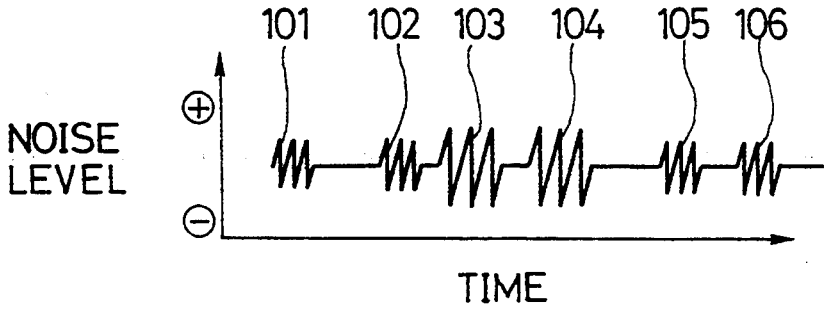
FIG. 2 is a schematic diagram showing the levels of noises generated when a workpiece is punched out.

FIG. 2 is a schematic diagram showing the levels of noises generated when the workpiece W is punched out by a conventional punch tool. As shown in FIG. 2, a plurality of noises are generated within an extremely short period of time during a punching.

In FIG. 2, the numeral 101 indicates noises generated when the striker 25 of the punch press collides with the punch head 37. The numeral 102 indicates noises generated when the stripper plate 45 collides with the workpiece W. The numeral 103 indicates noises generated when the cutting edge 41*a* of the punch body 41 collides with the workpiece W. The numeral 104 indicates noises generated when the workpiece W is sheared and ruptured. The numeral 105 indicates noises generated when the cutting edge 41*a* of the punch body 41 is removed from the workpiece W during the upward restoration movement of the punch tool 17 after a punching. The numeral 106 indicates noises generated when the punch driver 39 collides with the punch guide 43 during the upward restoration movement of the punch tool 17.

During punching, an overall noise level is generally determined by the noises indicated by the numerals 102, 103, and 104 which have relatively high levels. In particular, if no shearing angle is provided at the cutting edge of the punch body 41, the noises 104 dominates. However, when the shearing angle is provided on the cutting edge 41*a* to give a slanted cutting edge, the noises 103 and 104 can be significantly reduced. This results in that the noises 102 dominate.

In the low noise punch tool according to the present invention, since the lower surface pad 63 formed of urethane is attached to the lower surface of the stripper plate 45, the level of the noises 102 can also be significantly reduced. That is, the lower surface urethane pad 63 attached to the lower surface of the stripper plate 45 can reduce the noises in combination with the shearing angle formed at the cutting edge 41*a* of the punch body 41. This means that, if only the lower surface urethane pad 63 is attached to the lower surface of the stripper plate 45 of the conventional punch tool without forming a shearing angle at the cutting edge portion 41*a*, it is impossible to obtain a sufficient noise reduction effect. This is because in such case, the level of the noises 104 generated when the workpiece W is sheared and ruptured can not be reduced.

Further, in the present embodiment shown in FIG. 1, the upper surface urethane pad 51 is attached to the punch head 37 in order to reduce the levels of the noises 101 generated when the striker 25 collides with the punch head 37. In addition, the urethane ring 53 is interposed between the punch driver 39 and the punch guide 43 to reduce the noises 106 generated when the punch driver 39 collides with the punch guide 43 during the upward restoration movement of the punch tool 17.

In summary, in the punch tool according to the present invention, it is possible to effectively reduce noise levels by use of the punch tool 17 formed with a shearing angle and the urethane pads 51 and 63, the urethane ring 53, and the urethane stripper spring 55 in combination.

Figure 3:
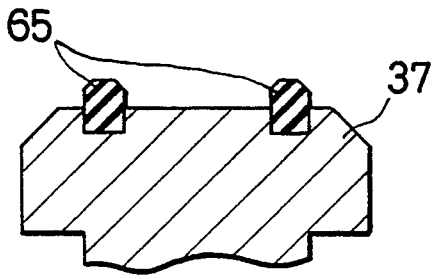
FIG. 3 is a partial longitudinal cross-sectional view showing another embodiment of the low noise punch tool according to the present invention.
Figure 4:
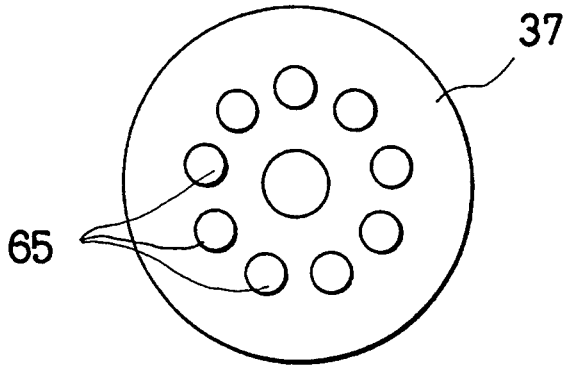
FIG. 4 is a plan view of the low noise punch tool shown in FIG. 3.

FIGS. 3 and 4 show another embodiment of the low noise punch tool according to the present invention. In this embodiment, a plurality of cusp push members (protruding members) 65 each formed of urethane are attached onto the upper surface of the punch head 37. The plurality of cusp push members are arranged circularly at regular angular intervals. With these push members 65, the noises 101 generated when the striker 25 collides with the punch head 37 can be reduced. In this embodiment, it is therefore possible to obtain the same noise reduction effect as with the case of the upper surface urethane pad 51 shown in FIG. 1.

In the same way, in this embodiment, a plurality of cusp push members 65 each formed of urethane are attached onto the lower surface of the stripper plate 45 in such a way as to be arranged circularly at regular angular intervals. With these push members 65, the noise 102 generated when the stripper plate 45 collides with the workpiece W is reduced. In this case, it is possible to obtain the same noise reduction effect as with the case of the lower surface urethane pad 63.

Further, in the low noise punch tool according to the present invention, the above-mentioned urethane pads 51 and 63, ring 53, and spring 55 can be modified, in shape and in material, from the embodiments as shown in FIGS. 1, 3, and 4.

As described above, in the low noise punch tool according to the present invention, the upper surface pad 51 formed of a low noise material such as urethane is attached to the upper surface of the punch head 37 with which the striker of the punch press collides. The stripper spring 55 formed of a low noise material such as urethane is also interposed between the punch head 37 and the punch guide 43. The ring 53 formed of a low noise material such as urethane is further interposed between the punch guide 43 and the punch driver 39. Yet further, the lower surface pad 63 is attached to the lower surface of the stripper plate 45 with which the workpiece W collides. Alternatively, a plurality of the cusp push members 65 formed of urethane may be arranged circularly on the upper surface of the punch head 37 and the lower surface of the stripper plate 45, instead of the pads. Accordingly, it is possible to provide a low noise punch tool which can effectively reduce noises generated when the workpiece is punched out, and is simple in structure.

What is claimed is:

1. A low noise punch tool comprising:

an upper surface pad formed of a low noise material and disposed on an upper surface of a punch head, said upper surface pad being struck by a striker of a punch press;

an elastic member formed of said low noise material and interposed between the punch head and a punch guide;

a lower surface pad formed of said low noise material and attached to a lower surface of a stripper plate provided at a lower end of the punch guide; and a ring formed of said low noise material, the ring being interposed between an upper surface of a stepped portion of the punch body and a lower surface of a flange portion of the punch guide to reduce noise generated when the punch body is brought into contact with the punch guide during an upward movement of the punch body.

2. The low noise punch tool of claim 1, wherein the upper surface pad and the lower surface pad include a plurality of cusp push members arranged circularly at regular angular intervals on the upper surface of the punch head and on the lower surface of the stripper plate, respectively.

3. The low noise punch tool of claim 1 wherein said low noise material is urethane.

4. The low noise punch tool of claim 3, wherein the stripper plate is attached to the punch guide by a plurality of plate push members and a plurality of push screws.

5. A low noise punch tool comprising:

an upper surface pad formed of a low noise material and disposed on an upper surface of a punch head;

an elastic member formed of said low noise material and interposed between the punch head and a punch guide; and a lower surface pad formed of said low noise material and attached to a lower surface of a stripper plate provided at a lower end of the punch guide;

wherein the upper surface pad and the lower surface pad include a plurality of cusp push members arranged circularly at regular angular intervals on the upper surface of the punch head and on the lower surface of the stripper plate, respectively.

* * * * *

UNITED STATES PATENT AND TRADEMARK OFFICE

CERTIFICATE OF CORRECTION

PATENT NO. : 5,410,927
DATED : May 2, 1995
INVENTOR(S) : H. OMATA et al.

It is certified that error appears in the above-indentified patent and that said Letters Patent is hereby corrected as shown below:

On the cover, in section [73], Assignees, line 1, change "Compmany," to ---Company,---.

On the cover, in section [73], Assignees, line 2, change "Meirecs" to ---Metrecs---.

At column 5, line 17 (claim 3, line 1), change "1" to ---1,---.

Signed and Sealed this

Twenty-second Day of October, 1996

*Attest:*

BRUCE LEHMAN

*Attesting Officer*

*Commissioner of Patents and Trademarks*